US011771144B1

(12) United States Patent
Vansia et al.

(10) Patent No.: US 11,771,144 B1
(45) Date of Patent: Oct. 3, 2023

(54) BRA, BRA CUP, AND METHOD OF MANUFACTURING SAME

(71) Applicant: Mast Industries (Far East) Limited, Kowloon (HK)

(72) Inventors: Mayur Vansia, Mendham, NJ (US); Jennifer Baratta, Brooklyn, NY (US); Yarden Gagnon, Brooklyn, NY (US); Ka Lai Tam, Shatin (HK); Ursula Giovanna Todaro, Glendale, NY (US); Suet Hing Yip, Tai Wai (HK); Kam Yin Wong, Tai Wai (HK)

(73) Assignee: Mast Industries (Far East) Limited, Kowloon Bay (HK)

( * ) Notice: Subject to any disclaimer, the term of this patent is extended or adjusted under 35 U.S.C. 154(b) by 0 days.

(21) Appl. No.: 18/155,375

(22) Filed: Jan. 17, 2023

(51) Int. Cl.
*A41C 3/00* (2006.01)
*A41C 5/00* (2006.01)

(52) U.S. Cl.
CPC ..... *A41C 3/0014* (2013.01); *A41C 5/005* (2013.01)

(58) Field of Classification Search
CPC ..... A41C 3/0014; A41C 3/005
USPC ..... 450/37, 39
See application file for complete search history.

(56) References Cited

U.S. PATENT DOCUMENTS 4,776,916 A 10/1988 Prunesti et al.
5,916,829 A * 6/1999 Girard ..... A41D 31/02 450/156
6,769,358 B2 8/2004 Jordan
7,422,508 B2 9/2008 Bentham
7,833,082 B2 11/2010 Bugada
8,317,567 B2 11/2012 Watrin et al.
9,456,638 B2 * 10/2016 Abbott ..... A41C 3/10
9,717,289 B1 8/2017 Fooden et al.
9,788,579 B2 10/2017 Miller et al.
10,051,896 B2 8/2018 Miller et al.
10,104,925 B2 10/2018 Farmer et al.
10,123,575 B2 11/2018 Funk-Danielson et al.
10,368,591 B2 8/2019 Funk-Danielson et al.
10,448,679 B1 * 10/2019 Roddis ..... A41C 3/0057
(Continued)

FOREIGN PATENT DOCUMENTS

CN 114098178 A 3/2022
CN 217446735 U 9/2022
(Continued)

OTHER PUBLICATIONS

The LYCRA Company, "Triumph is using LYCRA® FitSense™ technology to bring lightweight, targeted support to its SS20 Summer Sheer collection," web article, Apr. 14, 2020, available at https://www.lycra.com.cn/en/business/news/triumph-targeted-fit-leading-lingerie-brand-adopts-lycra-fitsense-technology.
(Continued)

*Primary Examiner* — Gloria M Hale
(74) *Attorney, Agent, or Firm* — ANDRUS INTELLECTUAL PROPERTY LAW, LLP

(57) ABSTRACT

A bra cup for a bra includes an inner layer of material configured to face a wearer's breast when the bra is worn and an outer layer of material configured to face away from the wearer when the bra is worn. An outer face of the inner layer of material is adjacent an inner face of the outer layer of material. A thin polymer web is disposed on the outer face of the inner layer of material. A bra including the bra cup and a method of manufacturing the bra cup are also disclosed.

20 Claims, 11 Drawing Sheets

(56) References Cited

U.S. PATENT DOCUMENTS

| | | | | |
|---|---|---|---|---|
| 10,681,941 | B2 | 6/2020 | Miller et al. | |
| 11,058,155 | B2 * | 7/2021 | Roddis ..... | A41C 5/005 |
| 11,312,808 | B2 | 4/2022 | Farmer et al. | |
| 2005/0159078 | A1 | 7/2005 | Querquant | |
| 2017/0342658 | A1 | 11/2017 | Kawamura | |
| 2019/0284325 | A1 | 9/2019 | Farmer et al. | |
| 2021/0172114 | A1 | 6/2021 | Farmer et al. | |
| 2022/0053841 | A1 | 2/2022 | Roddis et al. | |

FOREIGN PATENT DOCUMENTS

| | | | |
|---|---|---|---|
| CN | 115969107 | A | 4/2023 |
| DE | 19942996 | A1 | 3/2001 |
| DE | 202018103990 | U1 | 8/2018 |
| WO | 2021096430 | A1 | 5/2021 |
| WO | 2021173081 | A1 | 9/2021 |
| WO | 2021178372 | A1 | 9/2021 |
| WO | 2022086453 | A1 | 4/2022 |

OTHER PUBLICATIONS

Deric, Paolo, "Net Series," published on website Behance at least as early as 2013, https://www.behance.net/gallery/8303967/Net-series, accessed Nov. 4, 2022.

Lycra, "Why choose LYCRA FitSense Technology?", webpage, admitted prior art, https://www.lycra.com/en/business/search-technologies/lycra-fitsense-technology, accessed Nov. 4, 2022.

* cited by examiner

BRA, BRA CUP, AND METHOD OF MANUFACTURING SAME

FIELD

The present disclosure relates to bras, and more specifically to unlined bras that do not have padding.

BACKGROUND

The following patent and patent applications are provided by way of background information and are hereby incorporated herein by reference in their entireties.

U.S. Pat. No. 11,312,808 discloses aqueous polyurethane dispersions, prepolymers for formation of these dispersions, methods for their use in shaping articles, as well as shaping articles produced thereby.

U.S. Publication No. 2021/0172114 discloses methods for improving localized shaping and/or support functionalities, shape retention, comfort and/or stay of apparel and other fabric articles by applying an aqueous polyurethane dispersion at a selected intensity and/or at one or more selected locations of the apparel or other fabric article. Apparel and other fabric articles with improved localized shaping and/or support functionalities, shape retention comfort and/or stay prepared in accordance with these methods are also provided.

International Application Publication No. WO 2021/178372 discloses fabrics and garments and methods for producing these fabrics and garments having a thin polymer layer which reduces degree of nipple protrusion.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one aspect of the present disclosure, a bra cup for a bra includes an inner layer of material configured to face a wearer's breast when the bra is worn and an outer layer of material configured to face away from the wearer when the bra is worn. An outer face of the inner layer of material is adjacent an inner face of the outer layer of material. A thin polymer web is disposed on the outer face of the inner layer of material.

In one example, the thin polymer web comprises a plurality of line segments forming interconnected geometrical shapes. Optionally, a majority of the line segments in the plurality of line segments have a width of between 0.5 mm and 2.0 mm. In one particular example, a majority of the line segments in the plurality of line segments have a width of about 1.0 mm. Optionally, the geometrical shapes primarily comprise triangles.

In one example, the thin polymer web comprises an aqueous polyurethane dispersion. In one particular example, the aqueous polyurethane dispersion comprises a prepolymer comprising a glycol, an isocyanate, and a diol compound.

In one example, the thin polymer web extends over the entire outer face of the inner layer of material.

In one example, the thin polymer web extends over a first portion of the outer face of the inner layer of material that is configured to lie adjacent an underside of the wearer's breast when the bra is worn and over a second portion of the outer face of the inner layer of material that is configured to lie adjacent a laterally outer part of the wearer's breast when the bra is worn.

In one example, the inner layer of material comprises a mesh fabric and the outer layer of material comprises a lace fabric.

In one example, the inner and outer layers of material are coupled to each other only along an outer periphery of the bra cup.

According to another aspect of the present disclosure, a bra includes first and second bra cups, each of the first and second bra cups comprising a respective mesh layer configured to face a wearer's breast and a respective lace layer configured to face away from the wearer when the bra is worn. An outer face of the mesh layer is adjacent an inner face of the lace layer. A torso-encircling portion is coupled to at least one of the first bra cup and the second bra cup. A thin polymer web comprising an aqueous polyurethane dispersion is disposed on at least one of the outer face of the mesh layer and the inner face of the lace layer of each of the first and second bra cups. The thin polymer web comprises a plurality of line segments forming interconnected geometrical shapes. A majority of the line segments in the plurality of line segments have a width of between 0.5 mm and 2.0 mm.

In one example, the thin polymer web is disposed on the outer face of the mesh layer of each of the first and second bra cups, but not on the inner face of the lace layer of each of the first and second bra cups.

In one example, the thin polymer web extends over the entire outer face of the mesh layer of each of the first and second bra cups.

In one example, the thin polymer web extends over a first portion of the outer face of the mesh layer that is configured to lie adjacent an underside of the wearer's breast when the bra is worn and over a second portion of the outer face of the mesh layer that is configured to lie adjacent a laterally outer part of the wearer's breast when the bra is worn.

According to another aspect of the present disclosure, a method of manufacturing a bra cup for a bra includes: providing an inner layer of material configured to face a wearer's breast when the bra is worn; providing an outer layer of material configured to face away from the wearer when the bra is worn; disposing a thin polymer web on an outer face of the inner layer of material; and coupling the inner and outer layers of material together such that the outer face of the inner layer of material lies adjacent an inner face of the outer layer of material.

In one example, disposing the thin polymer web on the outer face of the inner layer of material comprises screen printing an aqueous polyurethane dispersion onto the outer face of the inner layer of material. Optionally, disposing the thin polymer web on the outer face of the inner layer of material comprises allowing the aqueous polyurethane dispersion to air dry for at least 30 minutes after the aqueous polyurethane dispersion has been screen printed onto the outer face of the inner layer of material and subsequently heat pressing or oven curing the inner layer of material with the dried aqueous polyurethane dispersion forming the thin polymer web disposed thereon.

In one example, the method further comprises layering the heat-pressed or oven-cured inner layer of material with the thin polymer web disposed thereon with the outer layer of material such that the outer face of the inner layer of material is adjacent the inner face of the outer layer of material; placing the layered inner and outer layers of material in a mold such that the outer layer of material is adjacent a female side of the mold and the inner layer of material is adjacent a male side of the mold; and molding the layered inner and outer layers of material together in the mold.

In one example, the thin polymer web comprises a plurality of line segments forming interconnected geometrical shapes. Optionally, a majority of the line segments in the plurality of line segments have a width of between 0.5 mm and 2.0 mm.

Various other features, objects, and advantages of the invention will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
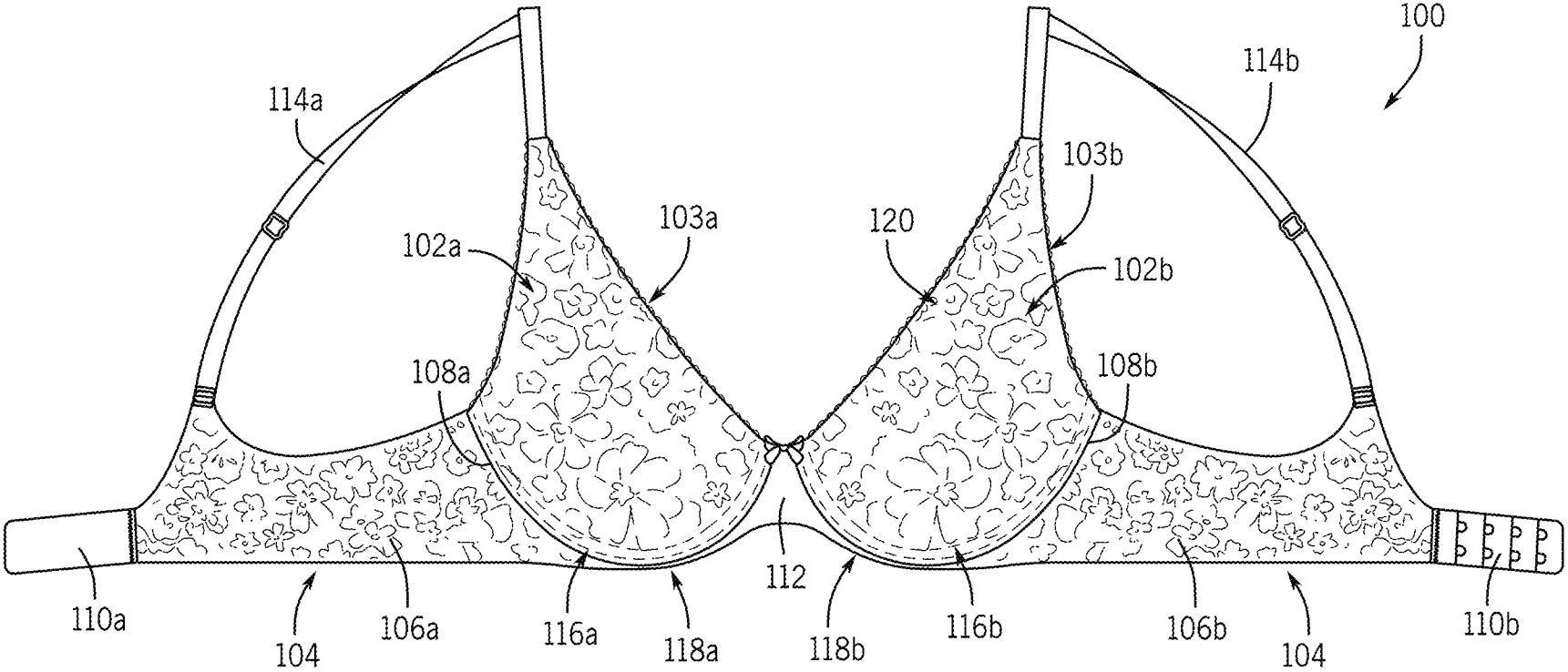
FIG. 1 illustrates a first example of a bra according to the present disclosure.

Before any embodiments of the invention are explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "linked," "supported," and "coupled" and variations thereof are used broadly and encompass both direct and indirect mountings, connections, supports, and couplings.

As used herein, unless otherwise limited or defined, discussion of particular directions is provided by example only, with regard to particular embodiments or relevant illustrations. For example, discussion of "top," "bottom," "front," "back," "left," "right," "lateral" or "longitudinal" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements from another. Unless otherwise specified or limited, the word "about" means ±10%. The phrase "at least about" means greater than or equal to the value recited ±10%. Unless otherwise specified or limited, the word "majority" means more than 50%.

Reference will be made herein to the "inner face" of a layer of material or a bra cup or to the "outer face" of a layer of material or a bra cup. The inner face is the surface that faces toward a wearer's skin when the bra is worn as intended. The outer face is the surface that faces outwardly away from the wearer when then bra is worn as intended.

As used herein, the term "dispersion" refers to a system in which the disperse phase consists of finely divided particles and the continuous phase can be a liquid, solid, or gas.

As used herein, the term "aqueous polyurethane dispersion" refers to a composition containing at least a polyurethane or polyurethane urea polymer or prepolymer (such as the polyurethane prepolymer described herein) that has been dispersed in an aqueous medium, such as water, including de-ionized water.

FIG. 1 shows one example of a bra 100 according to the present disclosure. The bra 100 has first and second bra cups 102*a*, 102*b* configured to cover a wearer's breasts when the bra 100 is worn as intended. The bra 100 also includes a torso-encircling portion 104 coupled to at least one of the first bra cup 102*a* and the second bra cup 102*b*. Here, the torso-encircling portion 104 includes a first wing 106*a* coupled to a laterally outer portion 108*a* of the first bra cup 102*a* and a second wing 106*b* coupled to a laterally outer edge 108*b* of the second bra cup 102*b*. A hook closure part 110*a* is provided on an opposite end of the first wing 106*a*, and an eye closure part 110*b* is provided on the opposite end of the second wing 106*b*. The hook and eye closure parts 110*a*, 110*b* can be coupled together to connect the free ends of the wings 106*a*, 106*b*, as is known. In other examples, the bra 100 may be a front-close bra with a closure in the center gore 112 between the two bra cups 102*a*, 102*b*, and in which the torso-encircling portion 104 is an uninterrupted band connected to both the laterally outer portion 108*a* of the first bra cup 102*a* and to the laterally outer edge 108*b* of the second bra cup 102*b*. The bra 100 also includes first and second straps 114*a*, 114*b* respectively connecting the upper side of the first bra cup 102*a* to the wing 106*a* in the rear of the bra 100 and the upper side of the second bra cup 102*b* to the wing 106*b* in the rear of the bra 100. In other examples, the bra 100 could be strapless. The bra 100 also includes underwires 116*a*, 116*b* at respective lower portions 118*a*, 118*b* and laterally outer edges 108*a*, 108*b* of the bra cups 102*a*, 102*b*, but in other examples, the bra 100 could be wireless.

Figure 2:
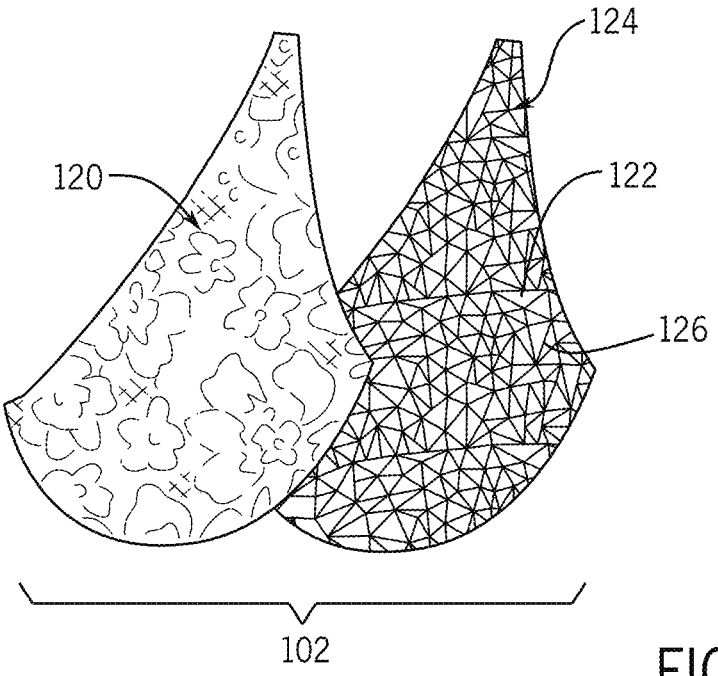
FIG. 2 illustrates the layers of a bra cup of the bra of FIG. 1.

In the example of FIG. 1, an outer layer of material 120 forming both the bra cups 102*a*, 102*b* and the bra wings 106*a*, 106*b* is lace. FIG. 2 shows both the outer layer of material 120 and an inner layer of material 122 of the bra cup 102*b*, which in this example is mesh. It should be understood that the following description of the bra cup 102*b* applies equally to the bra cup 102*a*, and together, each of the bra cups will be referred to as "102" for the sake of simplicity. As shown in FIG. 2, each of the first and second bra cups 102 comprises a respective mesh layer 122 configured to face a wearer's breast and a respective lace layer 120 configured to face away from the wearer when the bra 100 is worn. The mesh layer 122 may be made of cotton fibers, viscose fibers, nylon fibers, polyester fibers, elastane fibers, regenerative fibers such as vegetable fibers, or blends of any of these. The mesh layer 122 may be a power mesh having 15-50 holes per inch and a weight of 40 GSM to 200 GSM (preferably 100 GSM). In some examples, the mesh layer 122 may be made of 10 D to 200 D (preferably 40 D/34 F) nylon yarn and 20 D to 360 D (preferably 140 D) elastane yarn. In some examples, the mesh layer 122 may be 84% recycled nylon and 16% elastane. The mesh layer 122 has an inner face (123, FIG. 17) configured to face the wearer's breasts, which inner face 123 may be brushed. The mesh layer 122 also has an outer face 124, which in one example is the technical back of the mesh layer 122. The outer face 124 of the mesh layer 122 is situated adjacent an inner face (121, FIG. 17) of the lace layer 120. Also shown in FIG. 2 is a thin polymer web 126 disposed on the outer face 124 of the mesh layer 122 of each of the first and second bra cups 102. In one nonlimiting example, the thin polymer web 126 comprises an aqueous polyurethane dispersion as defined herein. In one nonlimiting example, the aqueous polyurethane dispersion comprises a prepolymer comprising a glycol, an isocyanate, and a diol compound, and optionally 1-hexanol. In one nonlimiting example, the thin polymer web described herein comprises a D58 aqueous dispersion such as that described in U.S. Pat. No. 11,312,808 and U.S. Publication No. 2021/0172114, incorporated herein by reference. D58 aqueous dispersions are sold by LYCRA® under the trademark FITSENSE™. In one example, the mesh layer 122 may include LYCRA® spandex so that the aqueous polyurethane dispersion impregnates the mesh layer 122 to some degree when applied. In other nonlimiting examples, the thin polymer web 126 may comprise silicone, one or more polyurethanes, one or more acrylics, or other resins.

According to the present disclosure, the thin polymer web 126 is disposed on at least one of the outer face 124 of the mesh layer 122 and the inner face 121 of the lace layer 120 of each of the first and second bra cups 102. As shown in FIG. 2, the thin polymer web 126 is disposed on the outer face 124 of the mesh layer 122 of each of the first and second bra cups 102, but not on the inner face 121 of the lace layer 120 of each of the first and second bra cups 102. This may be advantageous in that the outer layer of material 120 is able to cover any distortions in the inner layer of material 122 caused by deposition of the thin polymer web 126 thereon. However, in other examples it may be advantageous to dispose the thin polymer web 126 on the inner face of 121 the outer layer of material 120 only or on both the inner face 121 of the outer layer of material 120 and on the outer face 124 of the inner layer of material 122.

Figure 3:
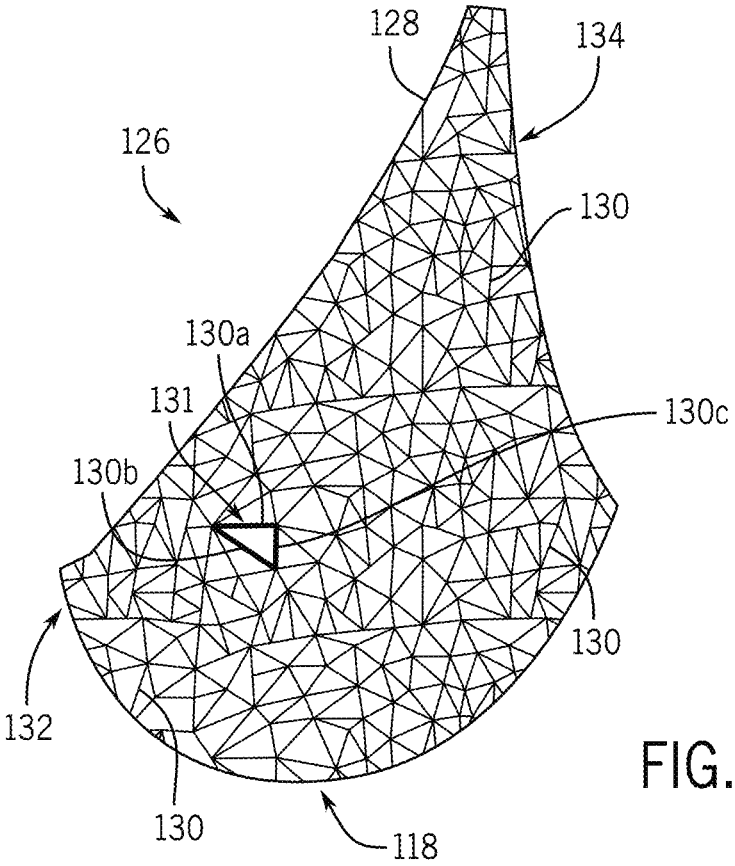
FIG. 3 illustrates a thin polymer web forming part of the bra cup of FIG. 2.

The thin polymer web 126 is shown in isolation in FIG. 3. It should be understood that the thin polymer web 126 need not include the outline 128 of the bra cup shape, but the outline 128 is shown here to illustrate how the thin polymer web 126 is oriented on the bra cup 102. The thin polymer web 126 comprises a plurality of line segments 130 forming interconnected geometrical shapes. There is no polymer disposed on the portions of the inner layer of material 122 between the line segments 130, i.e., the portions having the given geometrical shapes outlined by the line segments 130. For example, interconnected line segments 130*a-c* form a triangle 131, which is outlined in bold solely for purposes of illustration. While the sides/boundaries of the triangle 131 are defined by the thin polymer layer, there is no polymer inside the triangle 131. In the present example, a majority of the geometrical shapes are triangles. However, some of the geometrical shapes shown herein have more than three sides, and in other examples a majority of the geometrical shapes may be 4-, 5-, 6-, 7-, or 8-sided. In other examples, the line segments 130 could be curved line segments (arcs) and some or all the geometrical shapes could be circles, ovals, or other non-angular shapes. In still other examples, the plurality of line segments 130 may include both straight line segments and curved line segments.

According to the present disclosure, a majority of the line segments 130 in the plurality of line segments have a width (i.e., the lateral dimension of a line segment 130 when viewed in plan) of between 0.5 mm and 2.0 mm. More particularly, in one example, a majority of the line segments 130 in the plurality of line segments have a width of between 0.8 mm and 1.2 mm. Preferably, a majority of the line segments 130 in the plurality of line segments have a width of about 1.0 mm. In one particular example, more than 90% of the line segments 130 have a width of about 1.0 mm, which may prevent clogging of the holes in the mesh with polymer and which ensures that the inner layer of material 122 with the thin polymer web 126 is lightweight and breathable while still providing a desired level of support. A width greater than 1.0 mm can increase the stiffness of the inner layer of material 122, which may be undesirable or desirable depending on the application. In one example, the thickness (i.e., the dimension of a line segment 130 when viewed in elevation, as projecting from the face of the material onto which it is applied) of each line segment is 100 micron to 1500 micron, preferably 200 micron to 500 micron. In one example, each line segment 130 has a length (i.e., the longitudinal dimension of a line segment 130 when viewed in plan) of between 0.3 mm to 1.5 mm, more particularly between 0.5 mm and 1.2 mm.

Figure 19:
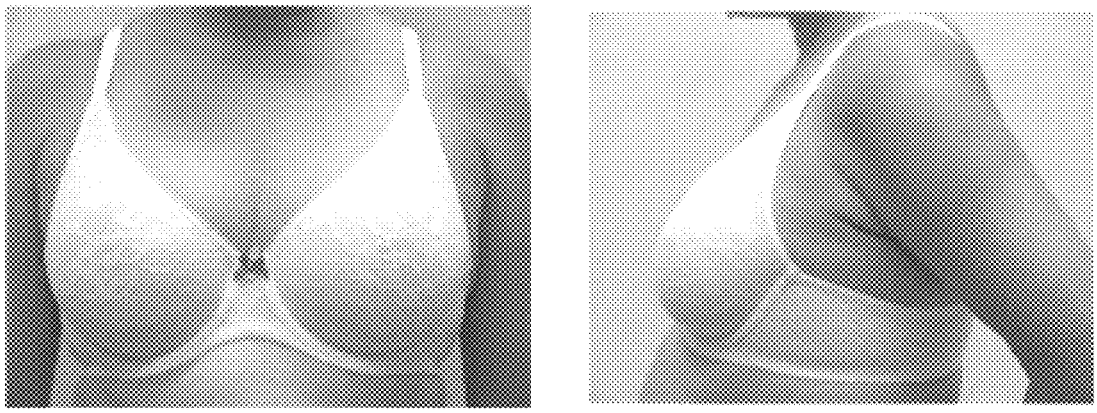
FIG. 19 (PRIOR ART)
FIG. 19 shows front and side views of a wearer wearing a prior art unlined lace bra.
Figure 20:
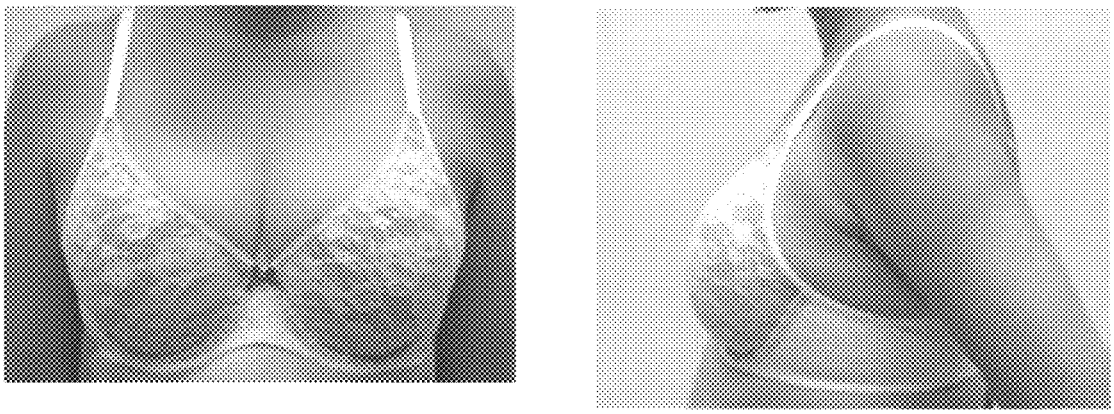
FIG. 20 shows front and side views of a wearer wearing a bra according to FIGS. 1-3 of the present disclosure.

In the example of FIGS. 2 and 3, the thin polymer web 126 extends over the entire outer face 124 of the inner layer of material 122. That is, the plurality of line segments 130 forming interconnected geometrical shapes extends over the entire outer face 124 of the inner layer of material 122, not including the areas between line segments 130 that are free of polymer. The bra 100 of FIG. 1, comprising the thin polymer web 126 extending over the entire outer face 124 of the mesh layer 122 of each of the first and second bra cups 102, performs as a minimizer bra. Minimizer bras are known for providing a smoother and less pronounced bust by limiting projection of a wearer's breasts by redistributing the breast tissue. Typically, minimizer bras include some level of padding or multiple layers of heavier fabrics to provide such function. However, through research and development, the present inventors have developed a minimizer bra that is considered by the industry to be "unlined." That is, the present minimizer bra 100 has only a thin lace layer 120 and a thin mesh layer 122 and does not have any padding or heavier weight fabric. Instead, the thin polymer web 126 provides the functions of lifting and controlling projection of the wearer's breasts. To provide such functions, there are more line segments 130 and the line segments 130 are closer together in areas of the bra cup 102 where more compression of breast tissue is needed, such as at the lower portion 118 of the bra cup 102 and the laterally inner portion 132 of the bra cup 102. In contrast, there are fewer line segments 130 and the line segments 130 are farther apart near the upper, laterally outer portion 134 of the bra cup 102 that connects to the strap 114 because there is less breast tissue there requiring compression. In one example, the bra 100 having minimizing bra cups 102*a*, 102*b* can reduce projection of a wearer's breasts by at least 1.375 inches (about 3.5 cm) in comparison to a bra with the same lace and mesh layers but no thin polymer web (e.g., a Victoria's Secret® Unlined Lace bra. This is because the thin polymer web 126 shown and described with respect to FIGS. 2 and 3 increases the weight of the inner mesh layer 122 by 120%, as well as increases the modulus of the mesh layer 122 at 50% elongation by 300%. FIG. 19 shows a wearer wearing such a prior art bra with an outer lace layer and an inner mesh layer, but no thin polymer web, while FIG. 20 shows the same wearer wearing a bra with the same lace and mesh layers and including the thin polymer web 126 of FIG. 3 applied to the outer face 124 of the inner layer of material 122. It can be seen that the projection of the wearer's breasts is greatly reduced in FIG. 20 when compared to FIG. 19.

In some examples, the bra 100 comprises only one layer of material and the thin polymer web 126 is provided on the outer face of that single layer of material. For instance, the bra 100 may comprise only a layer of lace, with the thin polymer web 126 disposed on the outer face of the lace. However, providing the mesh layer 122 may enhance the comfort of the bra 100, as mesh may be more comfortable against the wearer's skin than lace. The mesh layer 122 can be brushed on the inner face thereof that touches the wearer's skin, further enhancing the comfort against the wearer's skin in comparison to a mesh layer that is not brushed. Further, disposing the thin polymer web 126 on the mesh layer 122 instead of the lace layer 120 allows for easier manufacturing, as the same manufacturing process can be used on the same mesh layer 122 for every bra. The lace layer 120 can then be varied to provide a different aesthetic to each bra, and the manufacturing process does not need to be redeveloped to provide the thin polymer web 126 on each different type of lace that may be desired to be used in the bra 100.

Figure 4:
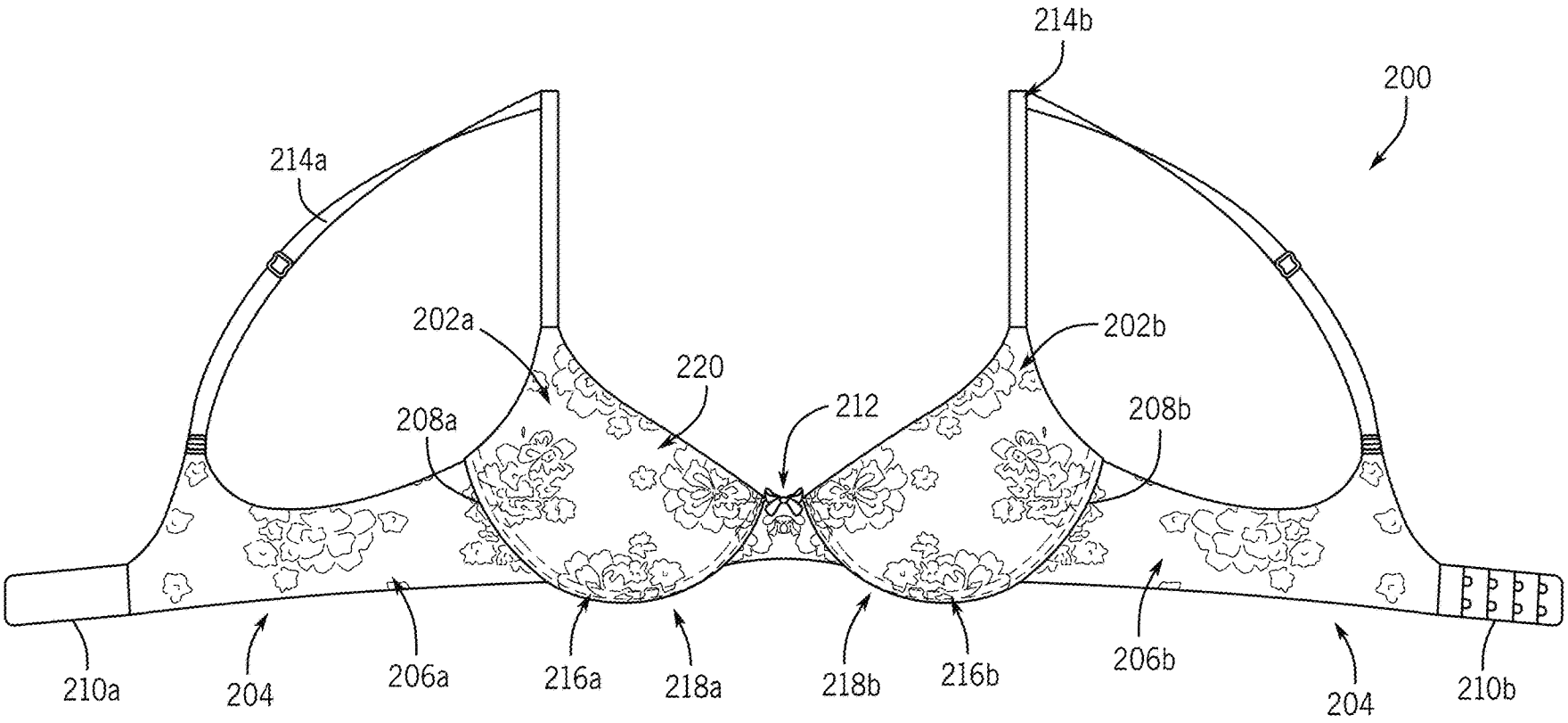
FIG. 4 illustrates a second example of a bra according to the present disclosure.

FIG. 4 shows another example of a bra 200 according to the present disclosure. The bra 200 has first and second bra cups 202*a*, 202*b* configured to cover a wearer's breasts when the bra 200 is worn as intended. The bra 200 also includes a torso-encircling portion 204 coupled to at least one of the first bra cup 202*a* and the second bra cup 202*b*. The remainder of the components of the bra 200 are similar to those described hereinabove with respect to the bra 100 of FIG. 1, with each like component bearing the same reference numbers in the tens and ones places, but bearing a "2" in the hundreds place.

Figure 5:
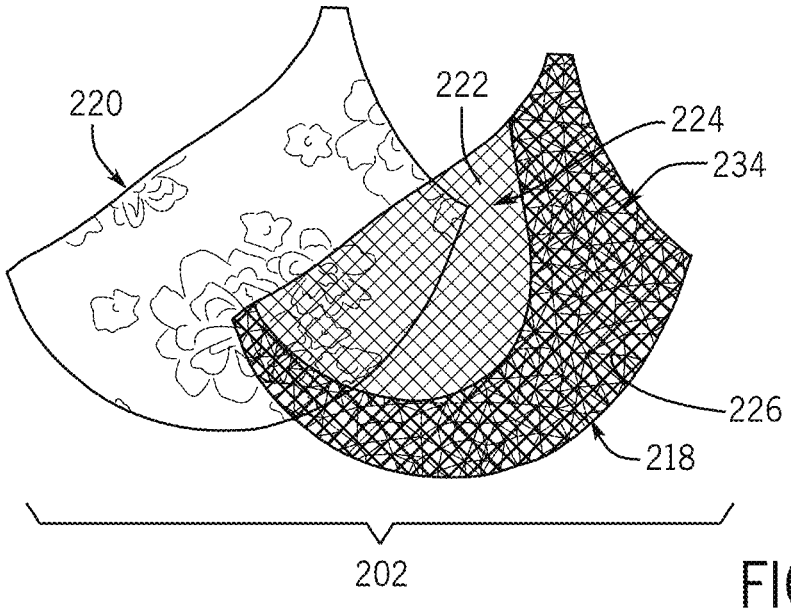
FIG. 5 illustrates the layers of a bra cup of the bra of FIG. 4.

In the example of FIG. 4, an outer layer of material 220 forming both the bra cups 202*a*, 202*b* and the bra wings 206*a*, 206*b* is lace. FIG. 5 shows both the outer layer of material 220 and an inner layer of material 222 of the bra cup 202*b*, which in this example is mesh. It should be understood that the following description of the bra cup 202*b* applies equally to the bra cup 202*a*, and together, each of the bra cups will be referred to as "202" for the sake of simplicity. As shown in FIG. 5, each of the first and second bra cups 202 comprises a respective mesh layer 222 configured to face a wearer's breast and a respective lace layer 220 configured to face away from the wearer when the bra 200 is worn. The mesh and lace layers may be the same as those described hereinabove with respect to the bra 100 of FIG. 1. The outer face 224 of the mesh layer 222 is situated adjacent an inner face of the lace layer 220. Also shown in FIG. 5 is a thin polymer web 226 disposed on the outer face 224 of the mesh layer 222 of each of the first and second bra cups 202. The thin polymer web 226 may comprise an aqueous polyurethane dispersion, silicone, one or more polyurethanes, one or more acrylics, or other resins as noted hereinabove with respect to the thin polymer web 126.

According to the present disclosure, the thin polymer web 226 is disposed on at least one of the outer face 224 of the mesh layer 222 and the inner face of the lace layer 220 of each of the first and second bra cups 202. As shown in FIG. 5, the thin polymer web 226 is disposed on the outer face 224 of the mesh layer 222 of each of the first and second bra cups 202, but not on the inner face of the lace layer 220 of each of the first and second bra cups 202. However, in other examples it may be advantageous to dispose the thin polymer web 226 on the inner face of the outer layer of material 220 only or on both the inner face of the outer layer of material 220 and on the outer face 224 of the inner layer of material 222.

Figure 6:
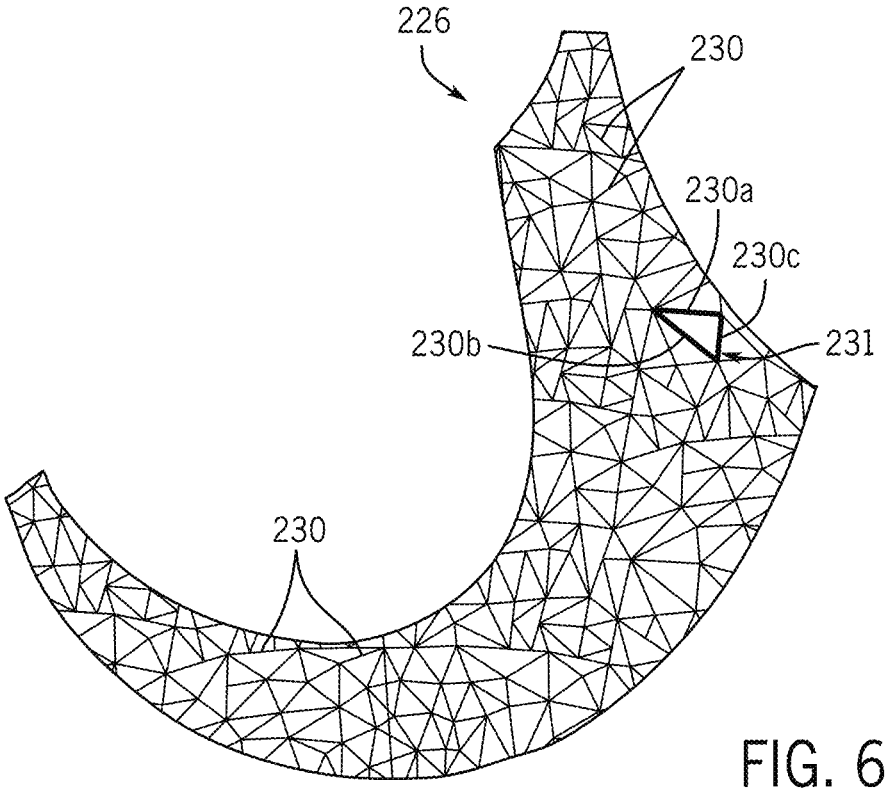
FIG. 6 illustrates a thin polymer web forming part of the bra cup of FIG. 5.

The thin polymer web 226 is shown in isolation in FIG. 6. The thin polymer web 226 comprises a plurality of line segments 230 forming interconnected geometrical shapes. There is no polymer disposed on the portions of the inner layer of material 222 between the line segments 230, i.e., the portions having the given geometrical shapes outlined by the line segments 230. For example, interconnected line segments 230*a-c* form a triangle 231, which is outlined in bold solely for purposes of illustration. While the sides/boundaries of the triangle 231 are defined by the thin polymer layer, there is no polymer inside the triangle 231. In the present example, a majority of the geometrical shapes are triangles; however, as noted hereinabove, other geometrical shapes, including curved/non-angular shapes, may be provided.

According to the present disclosure, a majority of the line segments 230 in the plurality of line segments have a width of between 0.5 mm and 1.5 mm. More particularly, in one example, a majority of the line segments 230 in the plurality of line segments have a width of about 1.0 mm. In one example, the thickness of each line segment is 100 micron to 1500 micron, preferably 200 micron to 500 micron. In one example, each line segment 230 has a length of between 0.3 mm to 1.5 mm, more particularly between 0.5 mm and 1.2 mm.

In the example of FIGS. 5 and 6, the thin polymer web 226 extends over a first portion 218 of the outer face 224 of the inner layer of material 222 (e.g., the mesh layer) that is configured to lie adjacent an underside of the wearer's breast when the bra 200 is worn and over a second portion 234 of the outer face 224 of the inner layer of material 222 (e.g., the mesh layer) that is configured to lie adjacent a laterally outer part of the wearer's breast when the bra 200 is worn. In this way, the thin polymer web 226 covers a somewhat crescent-shaped portion of the lower and laterally outer portions of the bra cup 202 to form a "sling" that supports the wearer's breasts from the underside and laterally outer side. The thin polymer web 226 may extend up to the area of the cup 202 that is configured to be attached to the strap 214*a* or 214*b* so as to distribute the weight of the breast tissue to the strap 214*a* or 214*b*. The support provided by the thin polymer web 226 is beyond that which would be provided by an unlined bra having only an inner mesh layer 222 and an outer lace layer 220 with no thin polymer web.

In some examples, the bra 200 comprises only one layer of material and the thin polymer web 226 is provided on the outer face of that single layer of material. For instance, the bra 200 may comprise only a layer of lace, with the thin polymer web 226 disposed on the outer face of the lace. However, providing the mesh layer 222 may enhance the comfort of the bra 200, as mesh may be more comfortable against the wearer's skin than lace. Further, disposing the thin polymer web 226 on the mesh layer 222 instead of the lace layer 220 allows for easier manufacturing as noted hereinabove.

The above examples of FIGS. 1-6 are of bras 100, 200 in which the inner layer of material 122, 222 comprises a mesh fabric and the outer layer of material 120, 220 comprises a lace fabric. In other examples, both the inner and outer layers of material could be mesh. Further, the thin polymer web 126, 226 may be advantageous in unlined bras having inner and outer layers of materials other than lace or mesh, as with the bra 300 of FIG. 7. The bra 300 has first and second bra cups 302*a*, 302*b* configured to cover a wearer's breasts when the bra 300 is worn as intended. The bra 300 also includes a torso-encircling portion 304 coupled to at least one of the first bra cup 302*a* and the second bra cup 302*b*. The remainder of the components of the bra 300 are similar to those described hereinabove with respect to the bra 100 of FIG. 1, with each like component bearing the same reference numbers in the tens and ones places, but bearing a "3" in the hundreds place.

Figure 7:
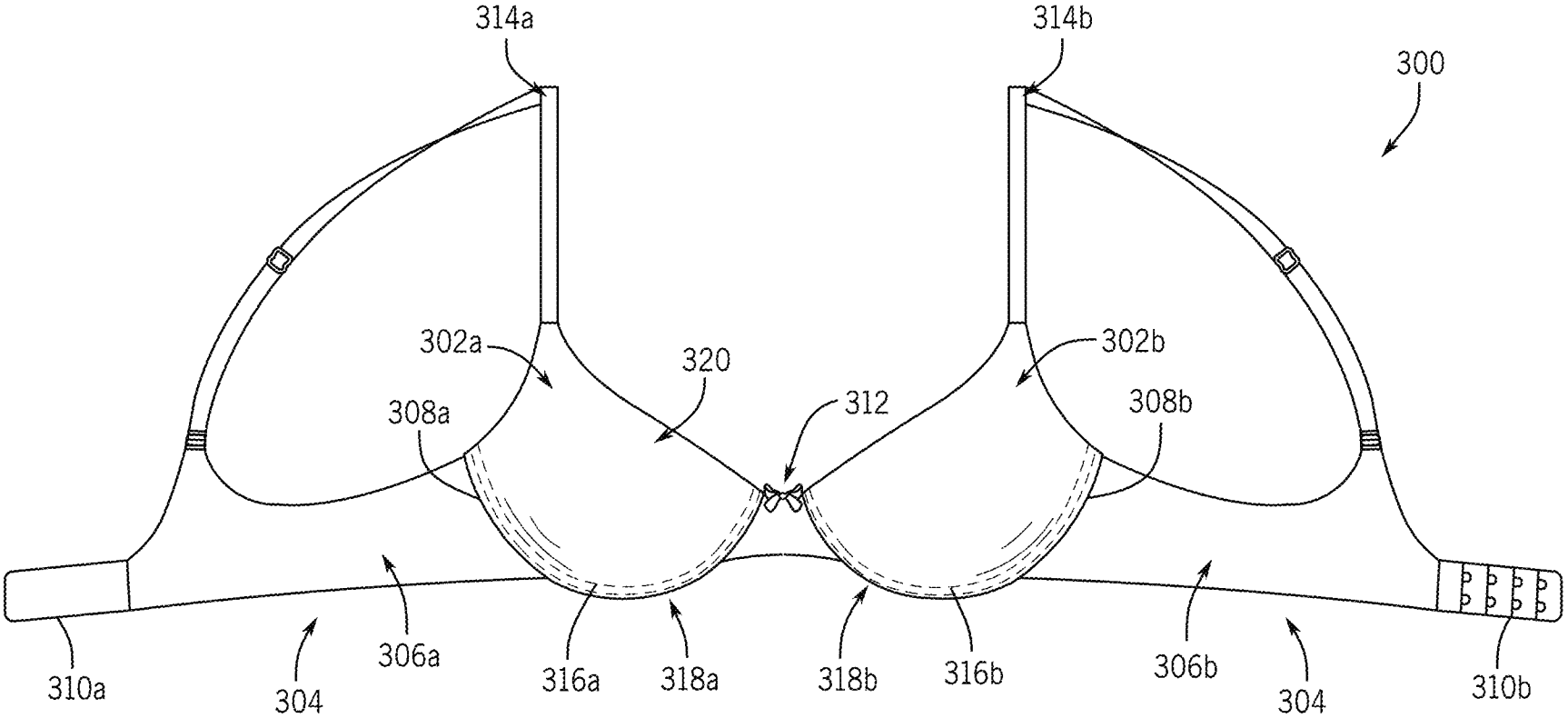
FIG. 7 illustrates a third example of a bra according to the present disclosure.
Figure 8:
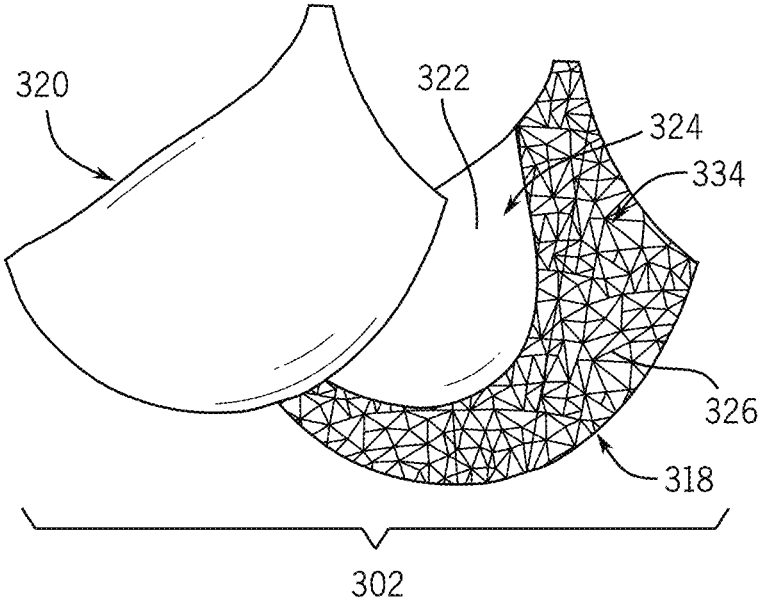
FIG. 8 illustrates the layers of a bra cup of the bra of FIG. 7.

In the example of FIG. 7, an outer layer of material 320 forming both the bra cups 302*a*, 302*b* and the bra wings 306*a*, 306*b* is a microfiber fabric. FIG. 8 shows both the outer layer of material 320 and an inner layer of material 322 of the bra cup 302*b*, which in this example is also a microfiber fabric. In other nonlimiting examples, the inner and outer layers of material 322, 320 can be knit fabrics made of cotton, viscose, nylon, polyester, elastane, modal, Lyocell, cuprammonium rayon, acetate, silk, wool, banana fiber, biobased fiber, thermoplastic polyurethane, or blends thereof. The inner and outer layers of material 322, 320 can be the same fabric or different fabrics. It should be understood that the following description of the bra cup 302*b* applies equally to the bra cup 302*a*, and together, each of the bra cups will be referred to as "302" for the sake of simplicity.

As shown in FIG. 8, each of the first and second bra cups 302 comprises a respective inner layer of material 322 configured to face a wearer's breast and a respective outer layer of material 320 configured to face away from the wearer when the bra 300 is worn. The outer face 324 of the inner layer of material 322 is situated adjacent an inner face of the outer layer of material 320. Also shown in FIG. 8 is a thin polymer web 326 disposed on the outer face 324 of the inner layer of material 322 of each of the first and second bra cups 302. The thin polymer web 326 may comprise an aqueous polyurethane dispersion, silicone, one or more polyurethanes, one or more acrylics, or other resins as noted hereinabove with respect to the thin polymer web 126.

According to the present disclosure, the thin polymer web 326 is disposed on at least one of the outer face 324 of the inner layer of material 322 and the inner face of the outer layer of material 320 of each of the first and second bra cups 302. As shown in FIG. 8, the thin polymer web 326 is disposed on the outer face 324 of the inner layer of material 322 of each of the first and second bra cups 302, but not on the inner face of the outer layer of material 320 of each of the first and second bra cups 302. However, in other examples it may be advantageous to dispose the thin polymer web 326 on the inner face of the outer layer of material 320 only or on both the inner face of the outer layer of material 320 and on the outer face 324 of the inner layer of material 322.

Figure 9:
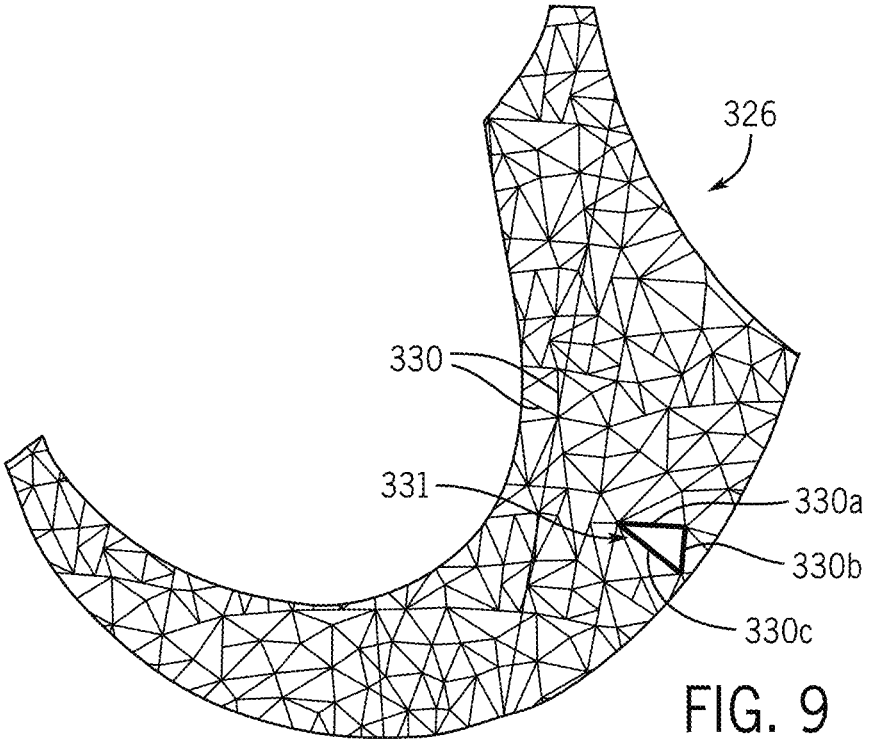
FIG. 9 illustrates a thin polymer web forming part of the bra cup of FIG. 8.

The thin polymer web 326 is shown in isolation in FIG. 9. The thin polymer web 326 comprises a plurality of line segments 330 forming interconnected geometrical shapes. There is no polymer disposed on the portions of the inner layer of material 322 between the line segments 330, i.e., the portions having the given geometrical shapes outlined by the line segments 330. For example, interconnected line segments 330*a-c* form a triangle 331, which is outlined in bold solely for purposes of illustration. While the sides/boundaries of the triangle 331 are defined by the thin polymer layer, there is no polymer inside the triangle 331. In the present example, a majority of the geometrical shapes are triangles; however, as noted hereinabove, other geometrical shapes, including curved/non-angular shapes, may be provided.

According to the present disclosure, a majority of the line segments 330 in the plurality of line segments have a width of between 0.5 mm and 1.5 mm. More particularly, in one example, a majority of the line segments 330 in the plurality of line segments have a width of about 1.0 mm. In one example, the thickness of each line segment is 100 micron to 1500 micron, preferably 200 micron to 500 micron. In one example, each line segment 330 has a length of between 0.3 mm to 1.5 mm, more particularly between 0.5 mm and 1.2 mm.

In the example of FIGS. 8 and 9, the thin polymer web 326 extends over a first portion 318 of the outer face 324 of the inner layer of material 322 that is configured to lie adjacent an underside of the wearer's breast when the bra 300 is worn and over a second portion 334 of the outer face 324 of the inner layer of material 322 that is configured to lie adjacent a laterally outer part of the wearer's breast when the bra 300 is worn. In this way, the thin polymer web 326 covers a somewhat crescent-shaped portion of the lower and laterally outer portions of the bra cup 302 to form a "sling" that supports the wearer's breasts from the underside and laterally outer side. The thin polymer web 326 extends up to the area of the bra cup 302 that is configured to be attached to the strap 314*a* or 314*b* so as to distribute the weight of the breast tissue to the strap 314*a* or 314*b*. The support provided by the thin polymer web 326 is beyond that which would be provided by an unlined bra having only inner and outer layers of material 322, 320 with no thin polymer web.

In some examples, the bra 300 comprises only one layer of material and the thin polymer web 326 is provided on the outer face of that single layer of material. However, providing a second layer of material over the layer of material bearing the thin polymer web 326 may enhance the aesthetics of the bra 300 from the outside.

The present disclosure is therefore more generally related to a bra cup 102, 202, 302 for a bra 100, 200, 300. The bra cup 102, 202, 302 comprises an inner layer of material 122, 222, 322 configured to face a wearer's breast when the bra 100, 200, 300 is worn. The bra cup 102, 202, 302 also comprises an outer layer of material 120, 220, 320 configured to face away from the wearer when the bra 100, 200, 300 is worn. An outer face 124, 224, 324 of the inner layer of material 122, 222, 322 is adjacent an inner face of the outer layer of material 120, 220, 320. A thin polymer web 126, 226, 326 is disposed on the outer face 124, 224, 324 of the inner layer of material 122, 222, 322. In a nonlimiting example, the thin polymer web 126, 226, 326 comprises a plurality of line segments 130, 230, 330 forming interconnected geometrical shapes. Through research and development, the present inventors have discovered that the varying orientations and sizes of the primarily triangular geometrical shapes formed by the plurality of line segments 130, 230, 330 in the above-noted bras 100, 200, 300 are particularly advantageous for providing breathable support that does not render the bra cups 102, 202, 302 too stiff. However, the thin polymer web 126, 226, 326 may have different forms than the examples shown in FIGS. 3, 6, and 9.

Figure 10:
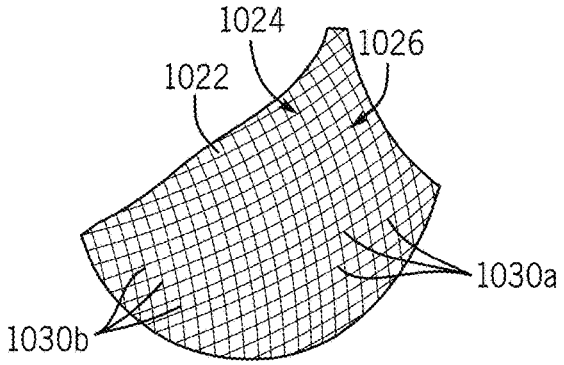
FIGS. 10-15 illustrate inner layers of bra cups with various examples of thin polymer webs disposed thereon.
Figure 11:
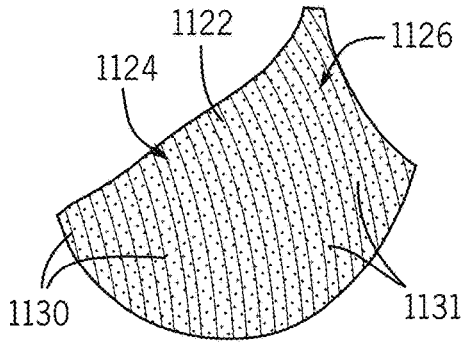

For example, FIG. 10 shows a thin polymer web 1026 formed of a first plurality of line segments 1030*a* that more or less follow the roughly horizontal curvature of the cup and a second plurality of line segments 1030*b* that more or less follow the roughly vertical curvature of the cup. Together, the pluralities of line segments 1030*a*, 1030*b* form a lattice-like structure over the entire outer face 1024 of the inner layer of material 1022 of the cup. FIG. 11 shows an example like that of FIG. 10, only the plurality of line segments 1130 are more vertically oriented than either of the pluralities of line segments 1030*a*, 1030*b* shown in FIG. 10. Further, pluralities of dots 1131 are aligned diagonally across the outer face 1124 of the inner layer of material 1122 of the cup instead of solid line segments. Together, the plurality of line segments 1130 and the pluralities of aligned dots 1131 form a lattice-like thin polymer web 1126 that may be somewhat less stiff than that of the thin polymer web 1026 of FIG. 10 due to the spaces between the dots in the pluralities of dots 1131.

Figure 12:
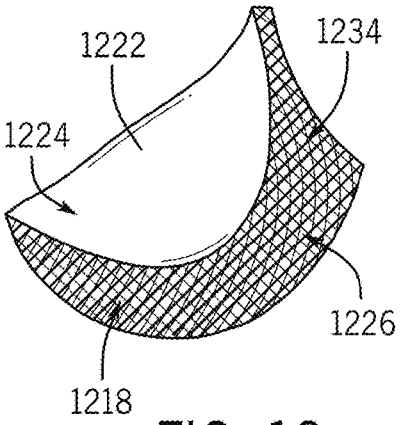
Figure 13:
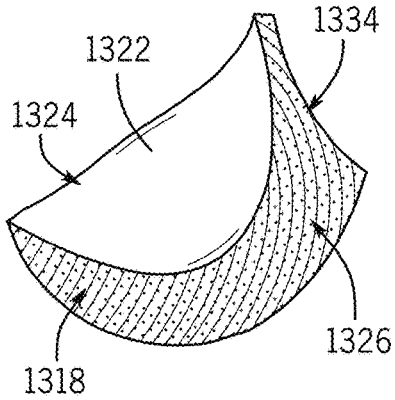

While FIGS. 10 and 11 show thin polymer webs 1026, 1126 that extend over the entire outer face 1024, 1124 of the inner layer of material 1022, 1122 and which may therefore be advantageous for use in a minimizer bra, FIGS. 12 and 13 show examples that may be used for bras in which the thin polymer web is arranged to provide a sling at the lower portion 1218, 1318 and laterally outer portion 1234, 1334 of the inner layer of material 1222, 1322. The example of FIG. 12 shows a sling formed of a thin polymer web 1226 comprising a first plurality of line segments on the diagonal, roughly parallel to the neckline edge of the cup, and a second plurality of line segments that are curved and cross with the first plurality of line segments. The example of FIG. 13 shows a sling formed of a thin polymer web 1326 comprising a plurality of line segments crossing with pluralities of aligned dots, like the example in FIG. 11. However, as noted, each thin polymer web 1226, 1326 covers only the sling area of the inner layer of material 1222, 1322, respectively, and the remainder of the outer face 1224, 1324 of the inner layer of material 1222, 1322 is not covered by the polymer.

Figure 14:
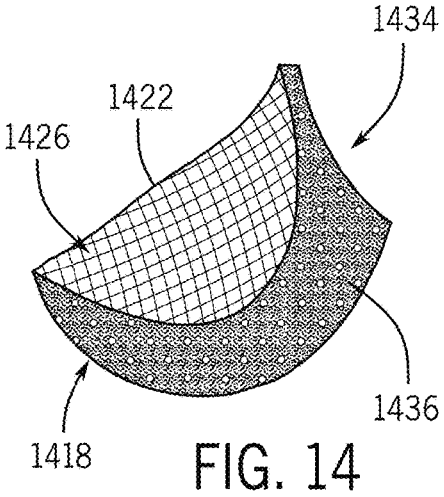
Figure 15:
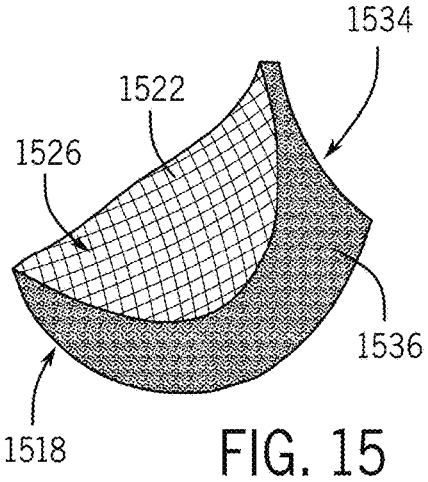

FIGS. 14 and 15 show examples in which the lattice-like pattern of crossing pluralities of lines of polymer as shown in FIG. 10 is used across the upper portion of the cup, but additional polymer is applied in the sling area of the cup. In FIGS. 14 and 15, the thin polymer web 1426, 1526 covers the inner layer of material 1422, 1522 in a lattice-like pattern, and a polymer layer 1436, 1536 is applied over the lower portion 1418, 1518 and the laterally outer portion 1434, 1534 of the inner layer of material 1422, 1522. The polymer layer 1536 is solid, while the polymer layer 1436 has apertures therethrough to provide more breathability and less stiffness in the sling area.

Figure 16:
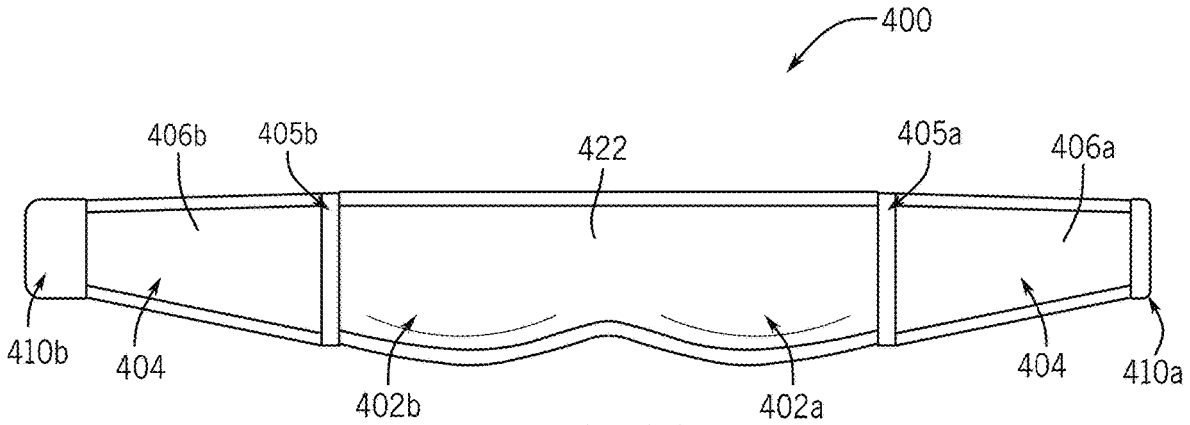
FIG. 16 illustrates a fourth example of a bra according to the present disclosure.

FIG. 16 shows another example of a bra 400 according to the present disclosure. The bra 400 is shown from its inner face and has first and second bra cups 402*a*, 402*b*, which are molded into a bandeau-type front panel and configured to cover a wearer's breasts when the bra 400 is worn as intended. The bra 400 also includes a torso-encircling portion 404 coupled to at least one of the first bra cup 402*a* and the second bra cup 402*b*. The remainder of the components of the bra 400 are similar to those described hereinabove with respect to the bra 100 of FIG. 1, with each like component bearing the same reference numbers in the tens and ones places, but bearing a "4" in the hundreds place, except that the bra 400 is strapless and includes boning 405*a*, 405*b* between the cups 402*a*, 402*b* and wings 406*a*, 406*b*.

Figure 16A:
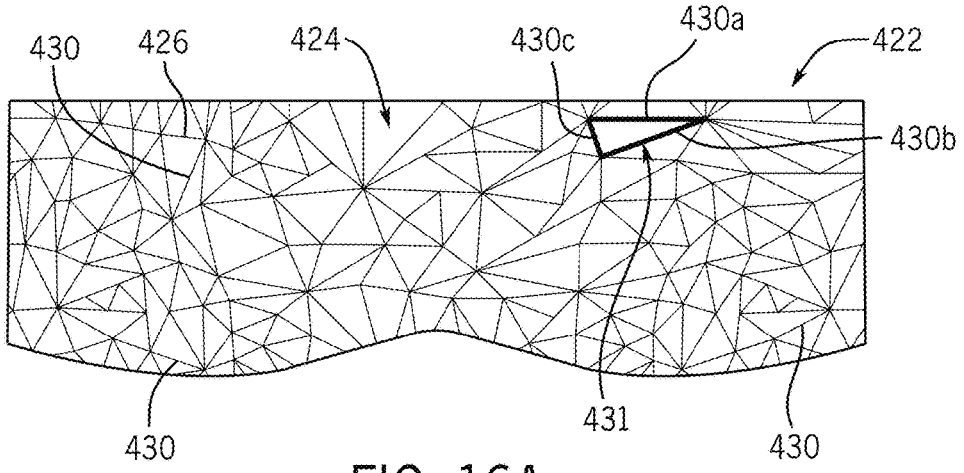
FIG. 16A illustrates one layer of a front panel of the bra of FIG. 16.

In the example of FIG. 16, an outer layer of material (not shown) forming both the bra cups 402*a*, 402*b* and the bra wings 406*a*, 406*b* is lace. The inner layer of material 422 of the bra cups 402*a*, 402*b*, can be, for example, mesh. Thus, each of the first and second bra cups 402*a*, 402*b* comprises a respective mesh layer 422 configured to face a wearer's breasts and a respective lace layer (not shown) configured to face away from the wearer when the bra 400 is worn. The mesh and lace layers may be the same as those described hereinabove with respect to the bra 100 of FIG. 1. The outer face 424 of the mesh layer 422 is situated adjacent an inner face of the lace layer. As shown in FIG. 16A, a thin polymer web 426 is disposed on the outer face 424 of the mesh layer 422 of each of the first and second bra cups 402*a*, 402*b*. The thin polymer web 426 may comprise an aqueous polyurethane dispersion, silicone, one or more polyurethanes, one or more acrylics, or other resins as noted hereinabove with respect to the thin polymer web 126.

According to the present disclosure, the thin polymer web 426 is disposed on at least one of the outer face 424 of the inner mesh layer 422 and the inner face of the outer lace layer of each of the first and second bra cups 402*a*, 402*b*. In this example, the thin polymer web 426 is disposed on the outer face 424 of the inner mesh layer 422 of each of the first and second bra cups 402*a*, 402*b*, but not on the inner face of the outer lace layer of each of the first and second bra cups 402*a*, 402*b*. However, in other examples it may be advantageous to dispose the thin polymer web 426 on the inner face of the outer layer of material only or on both the inner face of the outer layer of material and on the outer face 424 of the inner layer of material 422.

As shown in FIG. 16A, the thin polymer web 426 comprises a plurality of line segments 430 forming interconnected geometrical shapes. There is no polymer disposed on the portions of the inner layer of material 422 between the line segments 430, i.e., the portions having the given geometrical shapes outlined by the line segments 430. For example, interconnected line segments 430*a-c* form a triangle 431, which is outlined in bold solely for purposes of illustration. While the sides/boundaries of the triangle 431 are defined by the thin polymer layer, there is no polymer inside the triangle 431. In the present example, a majority of the geometrical shapes are triangles; however, as noted hereinabove, other geometrical shapes, including curved/non-angular shapes, may be provided.

According to the present disclosure, a majority of the line segments 430 in the plurality of line segments have a width of between 0.5 mm and 1.5 mm. More particularly, in one example, a majority of the line segments 430 in the plurality of line segments have a width of about 1.0 mm. In one example, the thickness of each line segment is 100 micron to 1500 micron, preferably 200 micron to 500 micron. In one example, each line segment 330 has a length of between 0.3 mm to 1.5 mm, more particularly between 0.5 mm and 1.2 mm.

Figure 17:
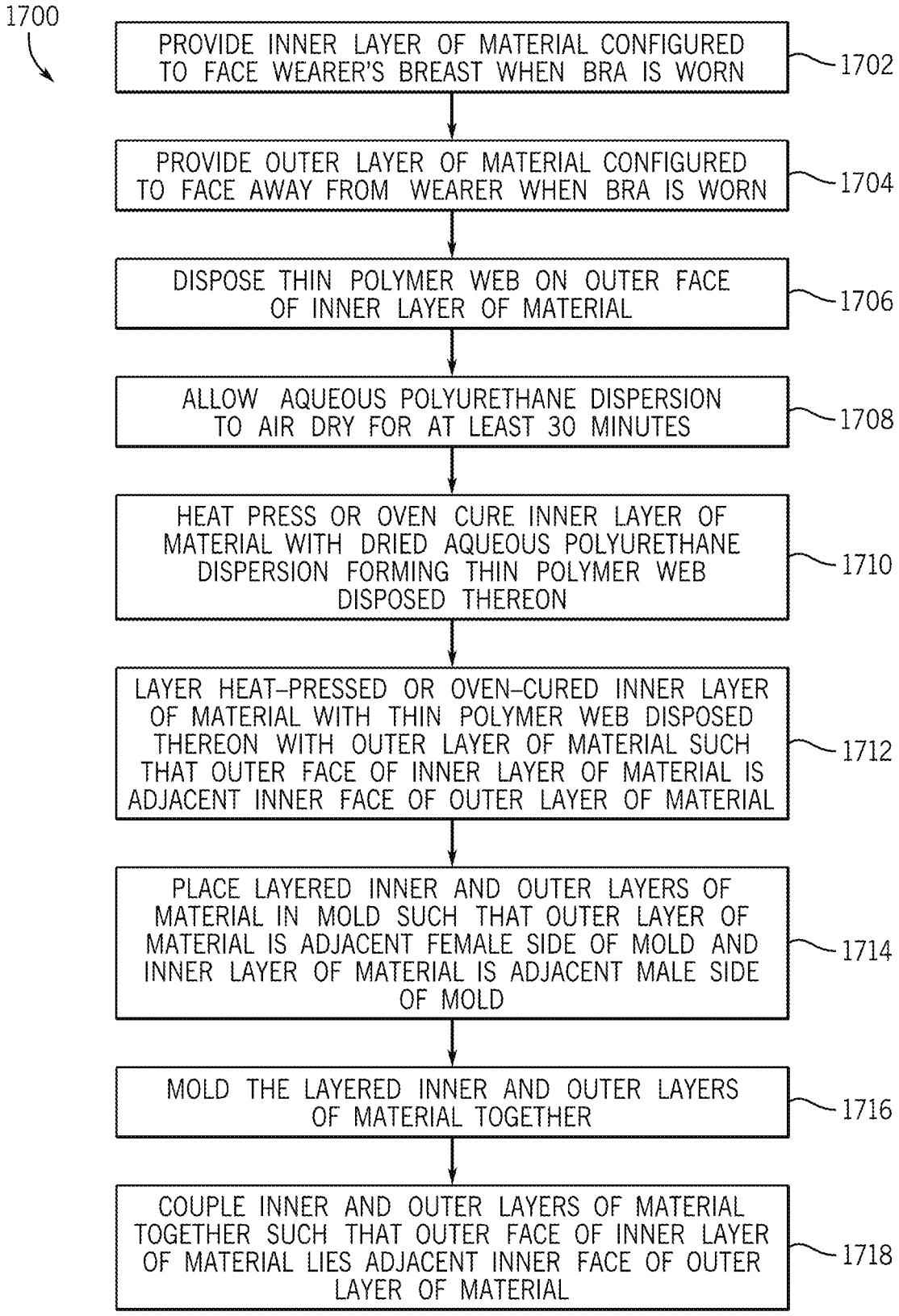
FIG. 17 shows a method of manufacturing a bra cup for a bra according to the present disclosure.
Figure 18:
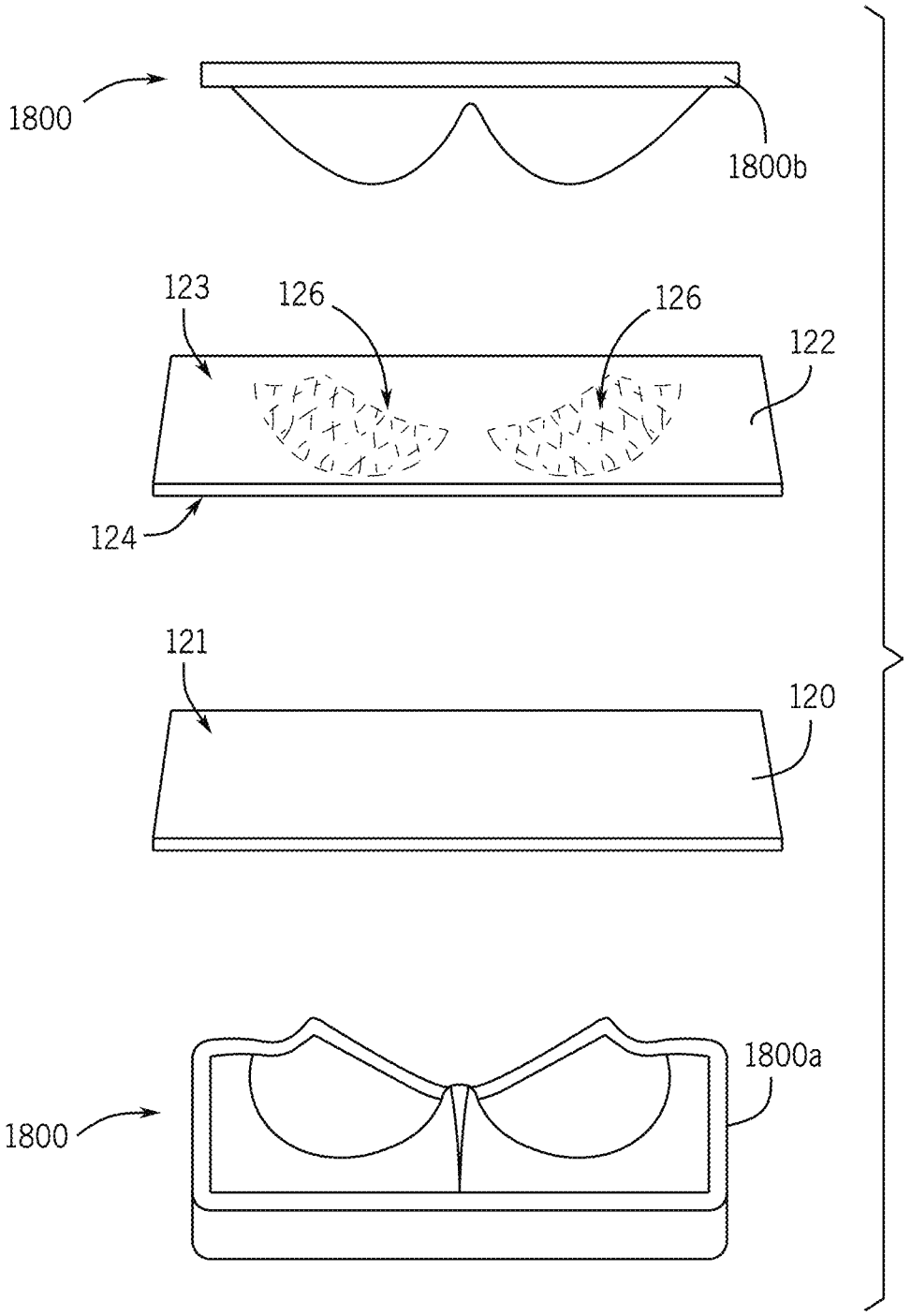
FIG. 18 shows the layers of a bra cup according to the present disclosure as they would be placed in a mold for molding the bra cup.

FIGS. 17 and 18 will be referred to in order to describe a method 1700 of manufacturing a bra cup 102, 202, 302, 402 for a bra 100, 200, 300, 400 according to the present disclosure. Although only reference numbers with 1's in the hundreds place will be referred to herein for the sake of simplicity, it should be understood that the method 1700 applies to each of the bra cups 102, 202, 302, 402 shown and described hereinabove with respect to FIGS. 1-16A.

The method 1700 includes providing an inner layer of material 122 configured to face a wearer's breast when the bra 100 is worn, as shown at 1702. The inner layer of material 122 may be mesh or a more closely knit fabric as noted hereinabove. The method also includes providing an outer layer of material 120 configured to face away from the wearer when the bra 100 is worn, as shown at 1704. The outer layer of material 120 may be mesh, lace, or a more closely knit fabric as noted hereinabove. After the inner layer of material 122 is provided, the method includes disposing a thin polymer web 126 on an outer face 124 of the inner layer of material 122, as shown at 1706. The thin polymer web 126 can be applied to selected locations of the inner layer of material 122 by methods such as, but not limited to, padding, coating, printing, painting, brushing, bonding, laminating, and spraying and combinations thereof. In one nonlimiting example, the polymer layer is printed onto the inner layer of material 122. In one particular example, disposing the thin polymer web 126 on the outer face 124 of the inner layer of material 122 comprises screen printing an aqueous polyurethane dispersion onto the outer face 124 of the inner layer of material 122.

In a nonlimiting example, to prepare for screen printing, the inner layer of material 122 may be placed on a lower frame that is situated on a plate, with the surface that will become the outer face 124 facing up. An upper frame can be aligned with the lower frame and placed on top of the inner layer of material 122 to hold the inner layer of material 122 in place. The plate holding the frames and inner layer of material is moved to the screen printing area. The screen printer is provided with a screen having apertures in the desired arrangement for printing and the plate is located under the screen such that the polymer will be printed on the desired locations on the inner layer of material 122. As noted above, the thin polymer web 126 comprises a plurality of line segments 130 forming interconnected geometrical shapes, and thus the apertures in the screen match the arrangement of the desired plurality of line segments 130 forming interconnected geometrical shapes. Also as noted above, a majority of the line segments in the plurality of line segments 130 have a width of between 0.5 mm and 1.5 mm, and thus the apertures cut in the screen accordingly have a width between 0.5 mm and 1.5 mm. In one example, the width of the apertures is 1.0 mm. The viscous aqueous polyurethane dispersion is disposed on the screen, after which the squeegees make at least one full pass (back and forth) across the screen to apply the aqueous polyurethane dispersion to the outer face 124 of the inner layer of material 122. Through research and development, the present inventors have determined that one back-and-forth pass and another single pass of printing deposits the preferable thickness (e.g., 100 micron to 1500 micron, preferably 200 micron to 500 micron) of aqueous polyurethane dispersion onto the outer face 124 of the inner layer of material 122. Less than a second may elapse between each pass of the squeegee so that the aqueous polyurethane dispersion does not dry during printing. Further, the screen and inner layer of material 122 may be kept moist with water vapor during printing so that the aqueous polyurethane dispersion does not dry during printing. After printing is complete, the plate, with the inner layer of material 122 still in the frame, can be removed from the printing area.

In one example, a double pallet, single head, automatic flat screen-printing machine may be used to carry out the screen printing. The printing may occur in a room having a temperature of 26.9° C. to 27.2° C. and a humidity between 67% to 70%.

In some instances in which the inner layer of material 122 is a mesh, the aqueous polyurethane dispersion may fill some of the holes in the mesh during the printing process. If this happens, the mesh may be blown with air to remove the aqueous polyurethane dispersion from the holes. To do so, the printed mesh may be placed between two screens and air may be vacuumed or blown at high pressure through the screens and the mesh. The polymer will remain on the fibers of the mesh, but the holes will no longer be filled with the polymer.

As shown at 1708, the method next includes allowing the aqueous polyurethane dispersion to air dry for at least 30 minutes after the aqueous polyurethane dispersion has been screen printed onto the outer face 124 of the inner layer of material 122. The present inventors have determined that allowing the aqueous polyurethane dispersion to dry for at least 30 minutes before heat pressing or oven curing allows the aqueous polyurethane dispersion to be printed onto materials such as lace or mesh, which have large openings between yarns/threads, with success. As shown at 1710, the method comprises subsequently heat pressing or oven curing the inner layer of material 122 with the dried aqueous polyurethane dispersion forming the thin polymer web 126 disposed thereon. The inner layer of material 122 may be placed between two release papers within the heat press and pressed at 120-140° C. for 30-60 seconds. In one particular example, the inner layer of material 122 with the thin polymer web 126 disposed thereon is heat pressed at 130° C. for 45 seconds, which may prevent a lightweight fabric from curling at higher temperatures. If the inner layer of material 122 is oven-cured, the time and temperature may be the same as those noted herein for heat pressing. The heat-pressed or oven-cured inner layer of material 122 may then be allowed to rest for at least 8 hours.

It should be understood that if the outer layer of material 120 is alternatively or additionally provided with the thin polymer web 126, the aqueous polyurethane dispersion may be disposed onto the desired face of the outer layer of material 120 in the same manner as that described hereinabove.

Next, the method 1700 comprises layering the heat-pressed or oven-cured inner layer of material 122 with the thin polymer web 126 disposed thereon with the outer layer of material 120 such that the outer face 124 of the inner layer of material 122 is adjacent the inner face 121 (FIG. 18) of the outer layer of material 120, as shown at 1712. This may be done in or out of the mold 1800 (FIG. 18). As shown at 1614, the method includes placing the layered inner and outer layers of material 122, 120 in the mold 1800 such that the outer layer of material 120 is adjacent a female side 1800*a* of the mold 1800 and the inner layer of material 122 is adjacent a male side 1800*b* of the mold 1800. The thin polymer web 126 is on the outer face 124 of the inner layer of material 122, which is opposite the inner face 123 shown here, and thus the thin polymer web 126 is shown in phantom. The thin polymer web 126 is located in each of two bra cup areas that are aligned with the convex portions of the male side 1800*b* of the mold 1800 and the concave portions of the female side 1800*a* of the mold 1800. The method next includes molding the layered inner and outer layers of material 122, 120 together (i.e., simultaneously) in the mold 1800, as shown at 1716. Thus, the thin polymer webs 126 are molded along with the inner and outer layers of material 122, 120 that will form the bra cups 102*a*, 102*b*. In one example, the mold is set at 185° C., and the layers are molded for 60 seconds. Through research and development, the present inventors realized that it is unusual for a polymer to be able to be molded at times and temperatures typical for bras, but the D58 aqueous polyurethane dispersion described hereinabove is able to be molded with no adverse effect on efficacy and without causing the polymer to melt or stick to the inner face 121 of the outer layer of material 120. After the layers are molded, they may be cut into the appropriate shapes for assembling into the bra cups 102*a*, 102*b*.

Finally, as shown at 1718, the method includes coupling the inner and outer layers of material 122, 120 together such that the outer face 124 of the inner layer of material 122 lies adjacent the inner face 121 of the outer layer of material 120 to form the bra cups 102*a*, 102*b*. In a nonlimiting example, the inner and outer layers of material 122, 120 are coupled to each other only along an outer periphery (103*a*, 103*b*, FIG. 1) of the bra cup 102*a*, 102*b*. That is, the inner and outer layers of material 122, 120 may be sewn and/or bonded to one another with or without trim and/or elastic bands at the neckline edges of the cups and the underarm edges of the cups and may be sewn and/or bonded to underwire channels holding the underwires 116*a*, 116*b* at the lower edges of the cups. The inner and outer layers of material 122, 120 are otherwise allowed to slip with respect to one another across the remainder of the bra cups 102*a*, 102*b*. This may be advantageous in that the outer layer of material 120 is not directly attached to the thin polymer web 126 and therefore hides the pattern of the thin polymer web 126 from view on the outside of the bra 100. Further, bonding the inner and outer layers of material 122, 120 together across the entirely of the cup may cause the cup to be stiff or less breathable and stitching other than at the periphery of the cup may cause irritation.

Although the present bras 100, 200, 300 are all constructed in a similar manner and have traditional full coverage with underwires, the present disclosure is equally applicable to strapless bras as shown in FIGS. 16 and 16A and to wireless bras, including, but not limited to, bralettes.

In the present description, certain terms have been used for brevity, clarity, and understanding. No unnecessary limitations are to be implied therefrom beyond the requirement of the prior art because such terms are used for descriptive purposes only and are intended to be broadly construed. The different assemblies described herein may be used alone or in combination with other systems. Various equivalents, alternatives, and modifications are possible within the scope of the appended claims.

What is claimed is:

1. A bra cup for a bra, the bra cup comprising:

an inner layer of material configured to face a wearer's breast when the bra is worn;

an outer layer of material configured to face away from the wearer when the bra is worn, an outer face of the inner layer of material being adjacent an inner face of the outer layer of material; and a thin polymer web disposed on the outer face of the inner layer of material.

2. The bra cup of claim 1, wherein the thin polymer web comprises a plurality of line segments forming interconnected geometrical shapes.

3. The bra cup of claim 2, wherein a majority of the line segments in the plurality of line segments have a width of between 0.5 mm and 2.0 mm.

4. The bra cup of claim 3, wherein a majority of the line segments in the plurality of line segments have a width of about 1.0 mm.

5. The bra cup of claim 2, wherein a majority of the geometrical shapes are triangles.

6. The bra cup of claim 1, wherein the thin polymer web comprises an aqueous polyurethane dispersion.

7. The bra cup of claim 6, wherein the aqueous polyurethane dispersion comprises a prepolymer comprising a glycol, an isocyanate, and a diol compound.

8. The bra cup of claim 1, wherein the thin polymer web extends over the entire outer face of the inner layer of material.

9. The bra cup of claim 1, wherein the thin polymer web extends over a first portion of the outer face of the inner layer of material that is configured to lie adjacent an underside of the wearer's breast when the bra is worn and over a second portion of the outer face of the inner layer of material that is configured to lie adjacent a laterally outer part of the wearer's breast when the bra is worn.

10. The bra cup of claim 1, wherein the inner layer of material comprises a mesh fabric and the outer layer of material comprises a lace fabric.

11. The bra cup of claim 1, wherein the inner and outer layers of material are coupled to each other only along an outer periphery of the bra cup.

12. A bra comprising:

first and second bra cups, each of the first and second bra cups comprising a respective mesh layer configured to face a wearer's breast and a respective lace layer configured to face away from the wearer when the bra is worn, an outer face of the mesh layer being adjacent an inner face of the lace layer;

a torso-encircling portion coupled to at least one of the first bra cup and the second bra cup; and a thin polymer web comprising an aqueous polyurethane dispersion disposed on at least one of the outer face of the mesh layer and the inner face of the lace layer of each of the first and second bra cups;

wherein the thin polymer web comprises a plurality of line segments forming interconnected geometrical shapes; and wherein a majority of the line segments in the plurality of line segments have a width of between 0.5 mm and 2.0 mm.

13. The bra of claim 12, wherein the thin polymer web is disposed on the outer face of the mesh layer of each of the first and second bra cups, but not on the inner face of the lace layer of each of the first and second bra cups.

14. The bra of claim 13, wherein the thin polymer web extends over the entire outer face of the mesh layer of each of the first and second bra cups.

15. The bra of claim 13, wherein the thin polymer web extends over a first portion of the outer face of the mesh layer that is configured to lie adjacent an underside of the wearer's breast when the bra is worn and over a second portion of the outer face of the mesh layer that is configured to lie adjacent a laterally outer part of the wearer's breast when the bra is worn.

16. A method of manufacturing a bra cup for a bra, the method comprising:

providing an inner layer of material configured to face a wearer's breast when the bra is worn;

providing an outer layer of material configured to face away from the wearer when the bra is worn;

disposing a thin polymer web on an outer face of the inner layer of material; and coupling the inner and outer layers of material together such that the outer face of the inner layer of material lies adjacent an inner face of the outer layer of material.

17. The method of claim 16, wherein disposing the thin polymer web on the outer face of the inner layer of material comprises screen printing an aqueous polyurethane dispersion onto the outer face of the inner layer of material.

18. The method of claim 17, wherein disposing the thin polymer web on the outer face of the inner layer of material comprises:

allowing the aqueous polyurethane dispersion to air dry for at least 30 minutes after the aqueous polyurethane dispersion has been screen printed onto the outer face of the inner layer of material; and subsequently heat pressing or oven curing the inner layer of material with the dried aqueous polyurethane dispersion forming the thin polymer web disposed thereon.

19. The method of claim 18, further comprising:

layering the heat-pressed or oven-cured inner layer of material with the thin polymer web disposed thereon with the outer layer of material such that the outer face of the inner layer of material is adjacent the inner face of the outer layer of material;

placing the layered inner and outer layers of material in a mold such that the outer layer of material is adjacent a female side of the mold and the inner layer of material is adjacent a male side of the mold; and molding the layered inner and outer layers of material together in the mold.

20. The method of claim 16, wherein:

the thin polymer web comprises a plurality of line segments forming interconnected geometrical shapes; and a majority of the line segments in the plurality of line segments have a width of between 0.5 mm and 2.0 mm.

* * * * *